US009742125B2

(12) United States Patent
Zhao et al.

(10) Patent No.: US 9,742,125 B2
(45) Date of Patent: Aug. 22, 2017

(54) ELECTRICAL CONNECTOR HAVING IMPROVED TERMINALS

(71) Applicant: FOXCONN INTERCONNECT TECHNOLOGY LIMITED, Grand Cayman (KY)

(72) Inventors: Jun Zhao, HuaiAn (CN); Jing-Jie Guo, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/161,292

(22) Filed: May 23, 2016

(65) Prior Publication Data

US 2016/0344142 A1 Nov. 24, 2016

(30) Foreign Application Priority Data

May 22, 2015 (CN) ..... 2015 1 0264188

(51) Int. Cl.

| | |
|---|---|
| ***H01R 13/6594*** | (2011.01) |
| ***H01R 13/6591*** | (2011.01) |
| ***H01R 24/60*** | (2011.01) |
| ***H01R 13/6471*** | (2011.01) |
| ***H01R 13/6588*** | (2011.01) |
| *H01R 13/6585* | (2011.01) |
| *H01R 13/6596* | (2011.01) |

(52) U.S. Cl.

CPC ..... *H01R 13/6594* (2013.01); *H01R 13/6471* (2013.01); *H01R 13/6588* (2013.01); *H01R 24/60* (2013.01)

(58) Field of Classification Search

CPC ..... H01R 13/6585; H01R 12/724; H01R 13/6594; H01R 13/6658; H01R 13/6591; H01R 13/6596

USPC ..... 439/607.05, 607.01, 607.54

See application file for complete search history.

(56) References Cited

U.S. PATENT DOCUMENTS

| | | | | |
|---|---|---|---|---|
| 9,300,095 | B2 * | 3/2016 | Lin | H01R 24/60 |
| 9,306,337 | B2 * | 4/2016 | Yu | H01R 24/60 |
| 9,466,924 | B2 * | 10/2016 | Lin | H01R 13/6585 |

(Continued)

FOREIGN PATENT DOCUMENTS

| | | | | |
|---|---|---|---|---|
| CN | 203859324 | | 10/2014 | |
| CN | 204243365 U | * | 4/2015 | H01R 12/71 |
| TW | M497371 | | 3/2015 | |

OTHER PUBLICATIONS

English Translation of CN 204243365.*

*Primary Examiner* — Amy Cohen Johnson
*Assistant Examiner* — Matthew T Dzierzynski
(74) *Attorney, Agent, or Firm* — Wei Te Chung; Ming Chieh Chang

(57) ABSTRACT

An electrical connector includes an insulative housing, a number of first contacts and second contacts carried by the housing, a metallic shielding plate received in the housing, and a shielding shell attached to the insulative housing. The first contacts and the second contacts have a number of grounding contacts. Each grounding contact of the first contacts has a first end portion located at a front end thereof. Each grounding contact of the second contacts has a second end portion located at a front end thereof and corresponding to the first end portion. The metallic shielding plate respectively is contacted with the first end portion and the second end portion.

17 Claims, 12 Drawing Sheets

(56) References Cited

U.S. PATENT DOCUMENTS

| | | | | |
|---|---|---|---|---|
| 9,478,915 | B2 * | 10/2016 | Guo | H01R 13/6585 |
| 9,484,679 | B2 | 11/2016 | Guo et al. | |
| 2015/0194772 | A1 | 7/2015 | Little et al. | |
| 2015/0244111 | A1 * | 8/2015 | Ju | H01R 13/6585<br>439/607.05 |
| 2015/0270661 | A1 * | 9/2015 | Kao | H01R 13/5202<br>439/271 |
| 2015/0364883 | A1 * | 12/2015 | Yu | H01R 13/6594<br>439/607.27 |
| 2016/0118750 | A1 | 4/2016 | Guo et al. | |
| 2016/0118752 | A1 | 4/2016 | Guo et al. | |

* cited by examiner

ELECTRICAL CONNECTOR HAVING IMPROVED TERMINALS

BACKGROUND OF THE INVENTION

1. Field of the Invention

The present invention relates to an electrical connector, and more particularly to an electrical connector with improved terminals.

2. Description of Related Art

Universal Serial Bus connectors are well known in the art. China Patent No. 204243365 discloses a reversible electrical connector. The electrical connector includes an insulative housing and upper and lower contacts on the housing. Each contact includes a contacting section. The contacts include grounding contacts each having a free end and a mounting leg mounted to corresponding grounding region of a printed circuit board. The free ends of paired upper grounding contact and lower grounding contact either abut against each other or against a metallic shielding plate embedded within a mating tongue to form a parallel relationship between the paired upper grounding contact and lower grounding contact. The contacting portions of the upper contacts are apt to separate from the contacting portions of the lower contacts under frequent insertion and withdrawal of a plug connector.

Hence, a new and simple electrical connector are desired.

SUMMARY OF THE INVENTION

Accordingly, the object of the present invention is to provide an electrical connector, comprising: an insulative housing; a plurality of first contacts carried by the housing and having a plurality of grounding contacts, each grounding contact of the first contacts having a first end portion located at a front end thereof; a plurality of second contacts carried by the housing and having a plurality of grounding contacts, each grounding contact of the second contacts having a second end portion located at a front end thereof and corresponding to the first end portion; a metallic shielding plate received in the housing, the metallic shielding plate respectively contacted with the first end portion and the second end portion; and a shielding shell attached to the insulative housing.

Other objects, advantages and novel features of the invention will become more apparent from the following detailed description when taken in conjunction with the accompanying drawings.

DETAILED DESCRIPTION OF THE PREFERRED EMBODIMENT

Figure 1:
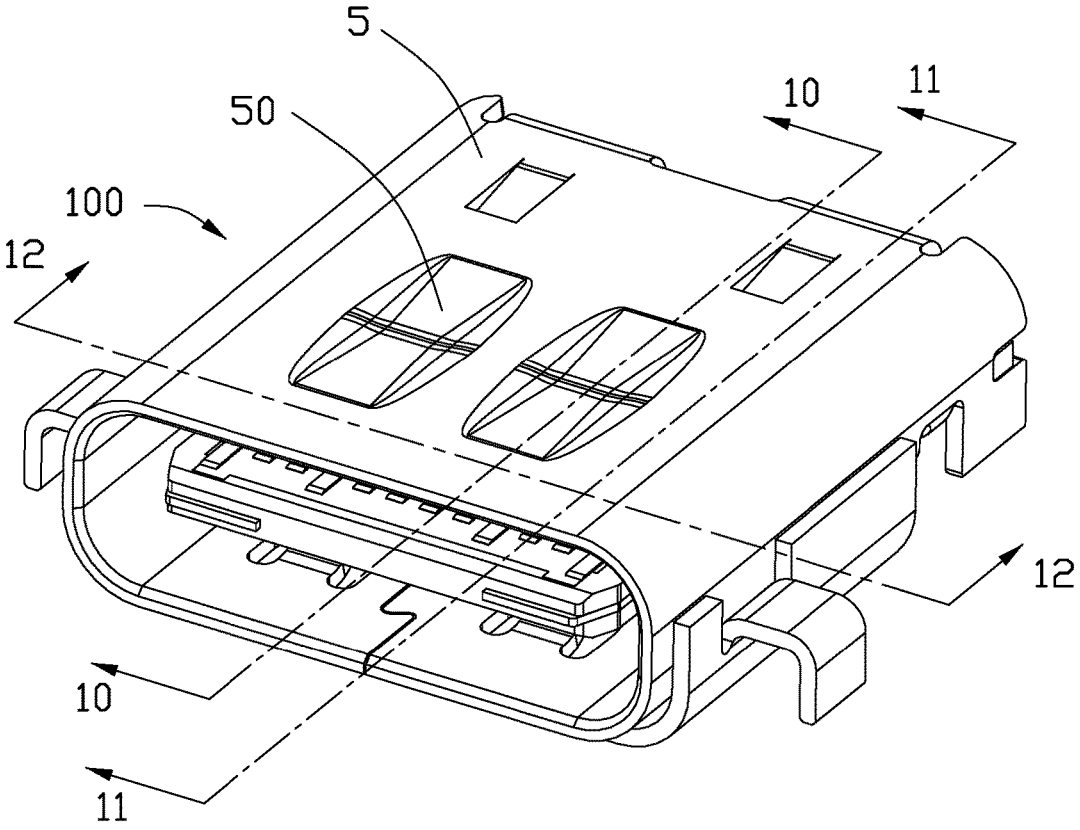
FIG. 1 is a perspective, assembled view of an electrical connector.
Figure 2:
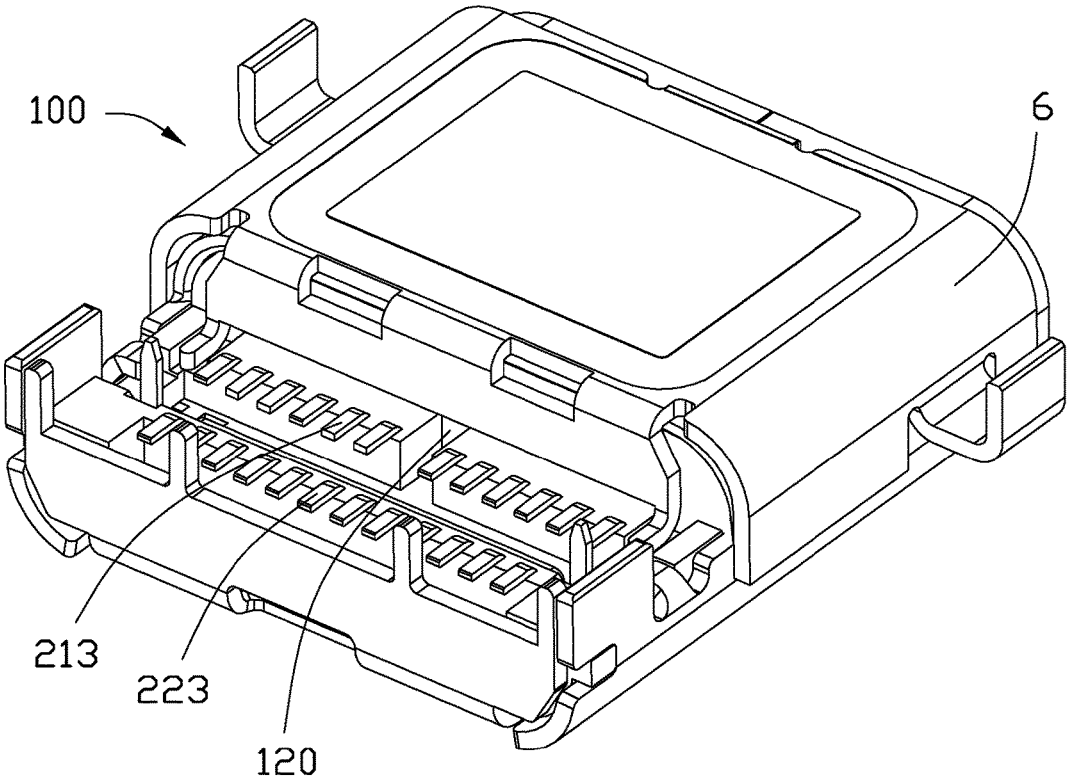
FIG. 2 is another perspective, assembled view of FIG. 1.
Figure 3:
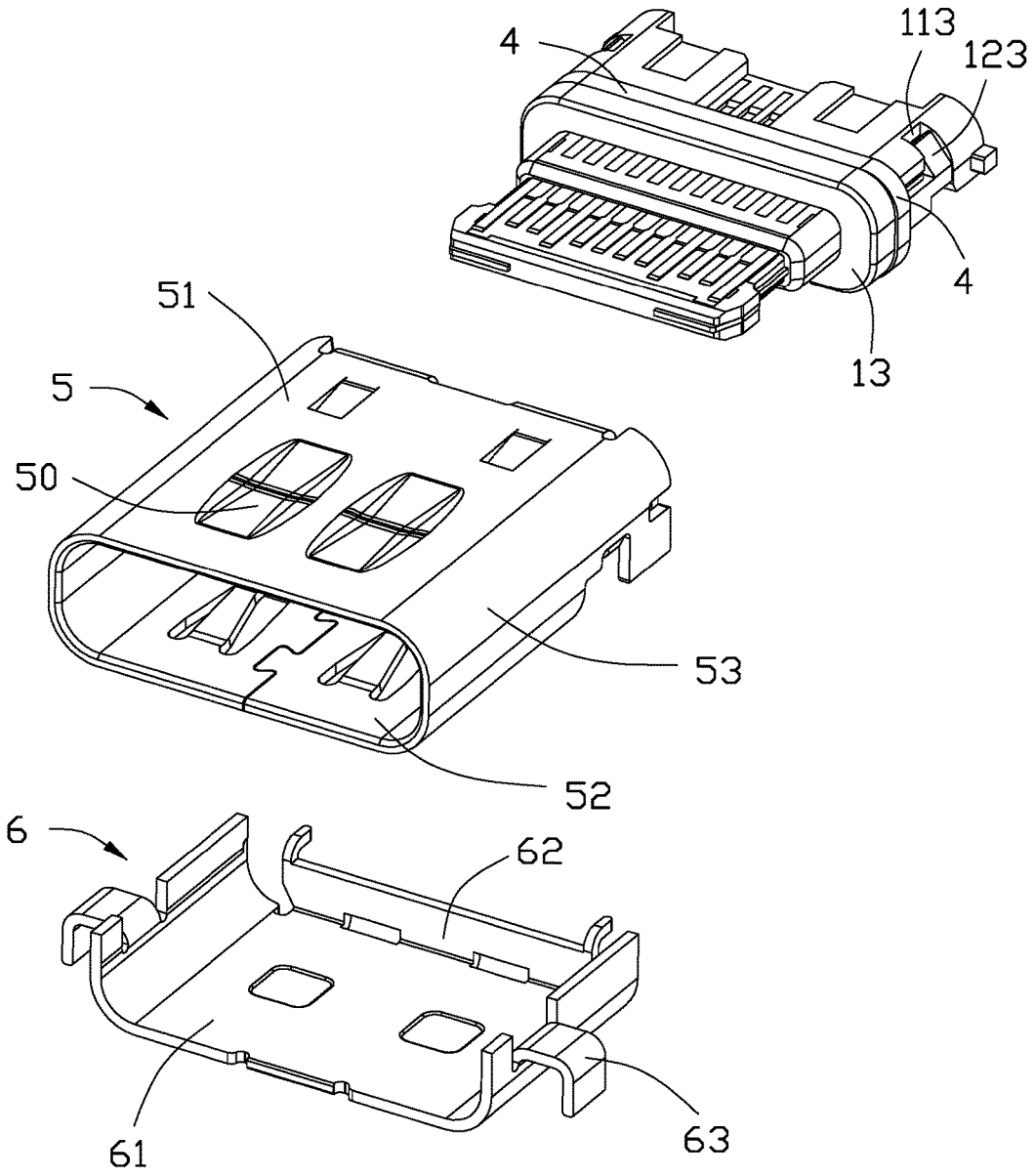
FIG. 3 is a perspective view of the electrical connector separated with a metal shell and a shielding shell.
Figure 4:
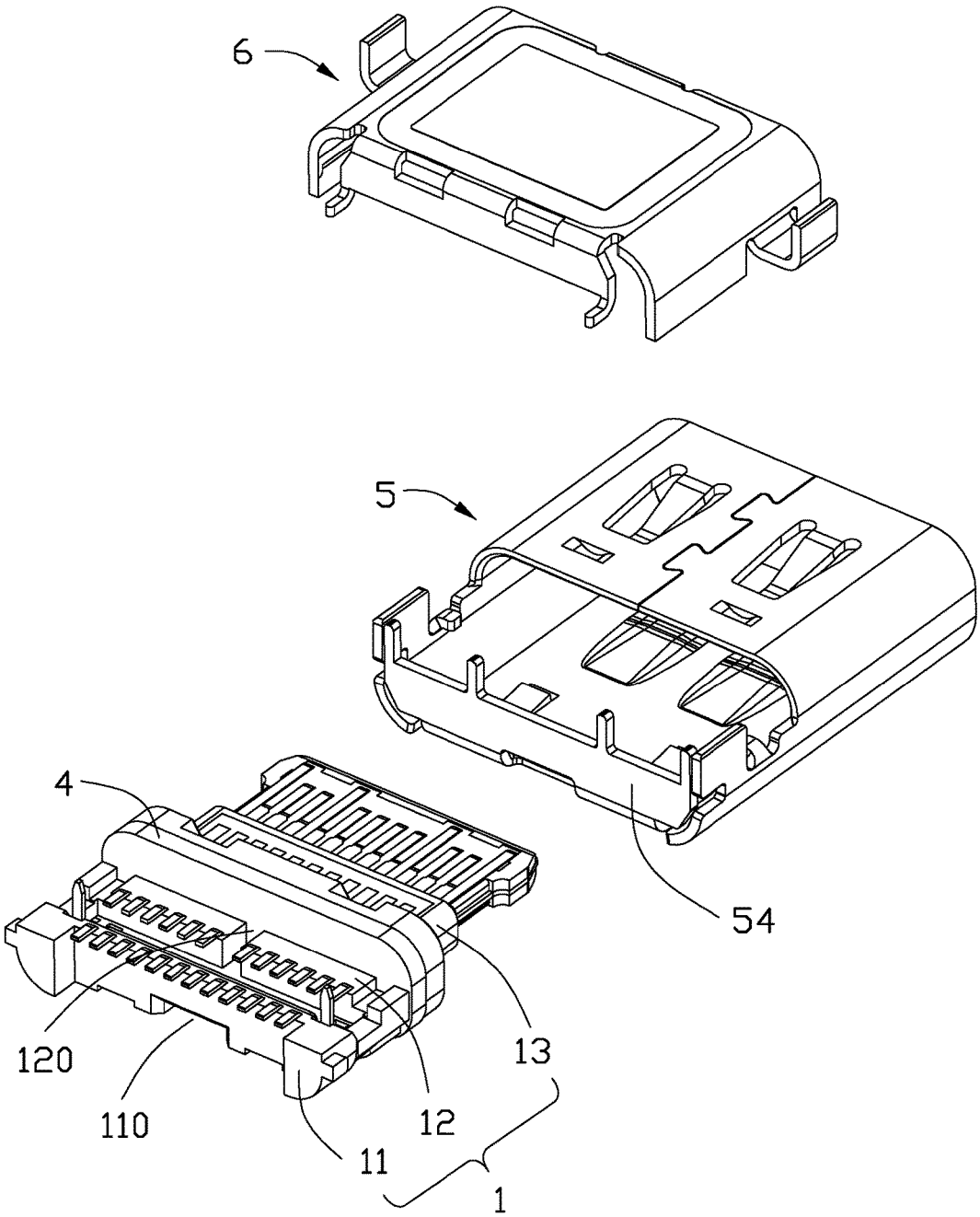
FIG. 4 is another perspective, assembled view of FIG. 3.
Figure 5:
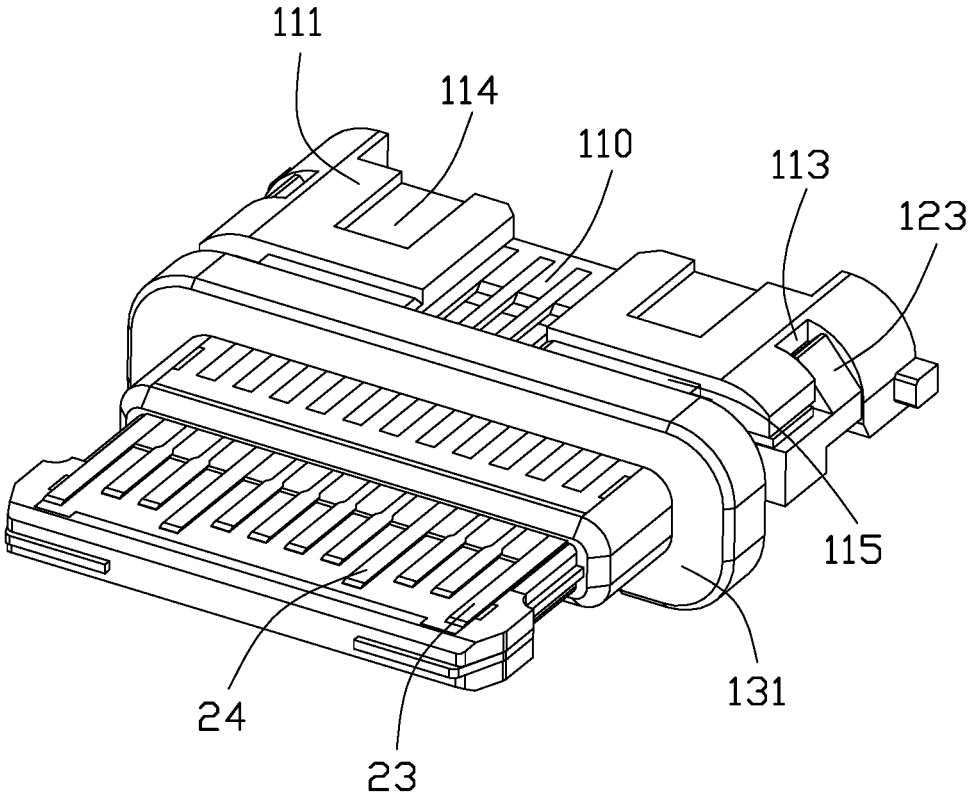
FIG. 5 is a perspective view of the housing, terminals, and the metallic shielding shell of the electrical connector.

Reference will now be made in detail to the preferred embodiment of the present invention.

FIGS. 1-12 show an electrical connector 100. For convenience, the electrical connector 100 defines a mating port cooperated with a plug connector. A mating direction, a transverse direction, and an up-and-down direction perpendicular to the mating direction and the transverse direction are defined. The mating direction and the transverse direction are formed with a horizontal plane.

Referring to FIGS. 1-9, the electrical connector 100 includes an insulative housing 1, a number of terminals 2 and a metallic shielding plate 3 retained in the insulative housing 1, a glue wall 4 made of glue for water resistance, a shielding shell 5 formed with a mating cavity to receive the insulative housing 1, and a metal shell 6 attached to the shielding shell 5.

Referring to FIGS. 3-8, the insulative housing 1 includes a first insulative housing 11 and a second insulative housing 12 disposed in the up-and-down direction, and a third insulative housing 13 accommodating the first insulative housing 11 and the second insulative housing 12. The first insulative housing 11 includes a first base portion 111 and a first tongue portion 112 extending forwardly from the first base portion 111. The first base portion 111 has a pair of depression 113 located at two sides thereof, a guiding portion 110 located at an upper surface for glue flowing therein, and a pair of receiving grooves 114 located at the two sides of the guiding portion 110. The first tongue portion 112 has a connecting portion 115 close to the first base portion 111.

The second insulative housing 12 includes a second base portion 121 and a second tongue portion 122 extending forwardly from the second base portion 121. The second base portion 121 has a pair of protrusions 123 extending upwardly and locking the depression 113 of the first insulative housing 11. The second tongue portion 122 has a number of guiding holes 120 located at a end thereof and communicated with the guiding portion 110. The third insulative housing 13 includes a third base portion 131 and a third tongue portion 132 extending forwardly from the third base portion 131. The third tongue portion 132 defines a hollow part 133 and a pair of notches 134 in two sides thereof. An upper surface of the third base portion 131 of the third insulative housing 13 is abreast of an upper surface of the guiding portion 110 of the first insulative housing 11.

Figure 9:
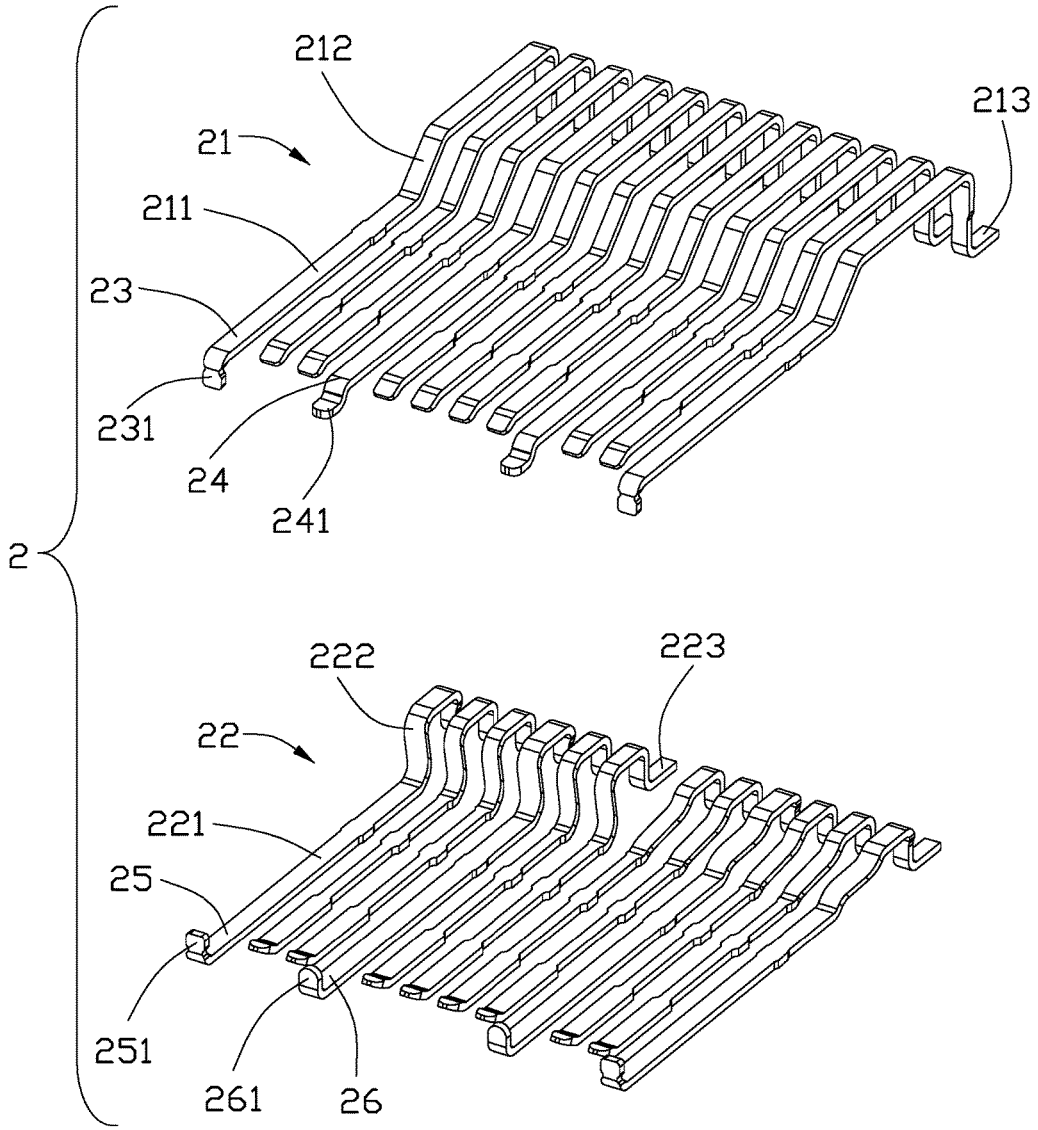
FIG. 9 is a perspective view of the terminals of the electrical connector.

Referring to FIG. 9, the terminals 2 includes a number of first contacts 21 carried by the first tongue portion 112 and a number of second contacts 22 carried by the second tongue portion 122. Each of the first contacts 21 includes a first contacting portion 211 disposed in an upper surface of the first tongue portion 112, a first affixed portion 212 received in the connecting portion 115, and a first soldering portion 213 extending from a back end of the first base portion 111. Each of the second contacts 22 includes a second contacting portion 221 disposed in a lower surface of the second tongue portion 122, a second affixed portion 222, and a second soldering portion 223 extending from a back end of the second base portion 121. The first contacts 21 and the second contacts 22 are positioned to have 180 degree symmetry such that the corresponding plug connector can be inserted and operatively coupled to the electrical connector 100 in either of two orientations. The first soldering portion 21 and the second soldering portion 222 are located at a same plane and configured in two rows to observe in assembly.

The first contacts 21 and the second contacts 22 extending in a mating direction respectively includes four power contacts located forwardly and eight signal contacts located backwardly. The two power contacts in the middle are used to provide electric source and the other two are used for electrical grounding. The eight signal contacts includes four super-speed differential contacts located at two sides, two low-speed differential contacts located in the middle, and a pair of controlling contacts. Each of the first contacts 21 is associated with a respective one of the second contacts 22 and is positioned in reverse symmetry with respect to the second contacts 22. The power contacts used for electrical grounding include a pair of first grounding contacts 23 located at two outermost edges of the first contacts 21 and a pair of second grounding contacts 25 located at two outermost edges of the second contacts 22. The power contacts used to provide electric source include a pair of first power contacts 24 located at middle of the first contacts 21 and a pair of second power contacts 26 located at middle of the second contacts 22.

Figure 6:
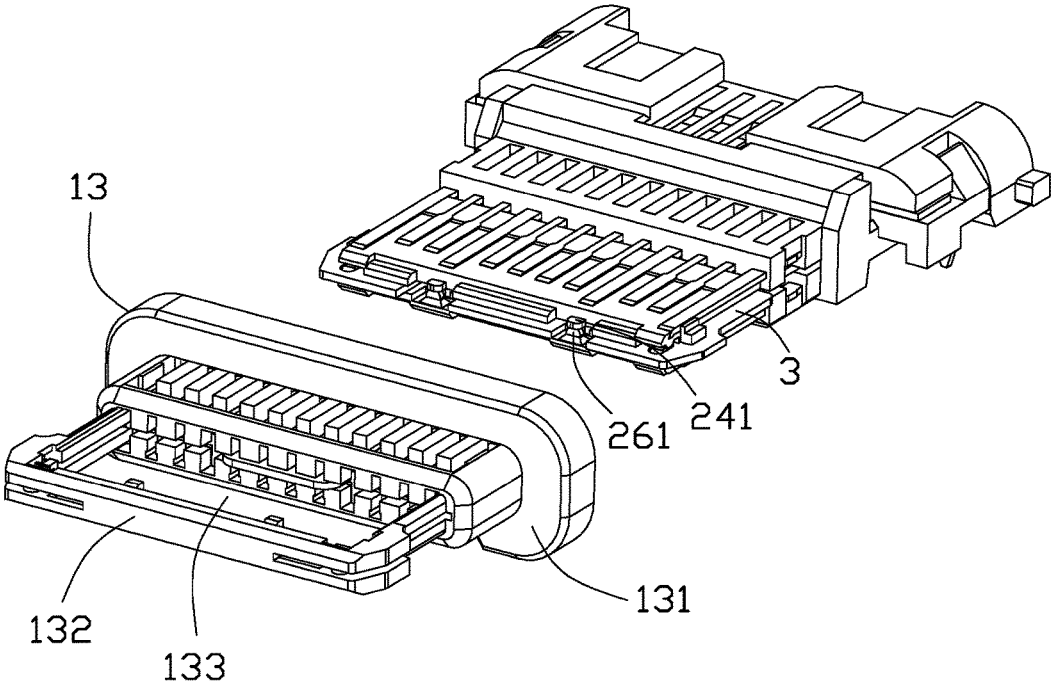
FIG. 6 is a perspective view of FIG. 5 separated with a third insulative housing.
Figure 10:
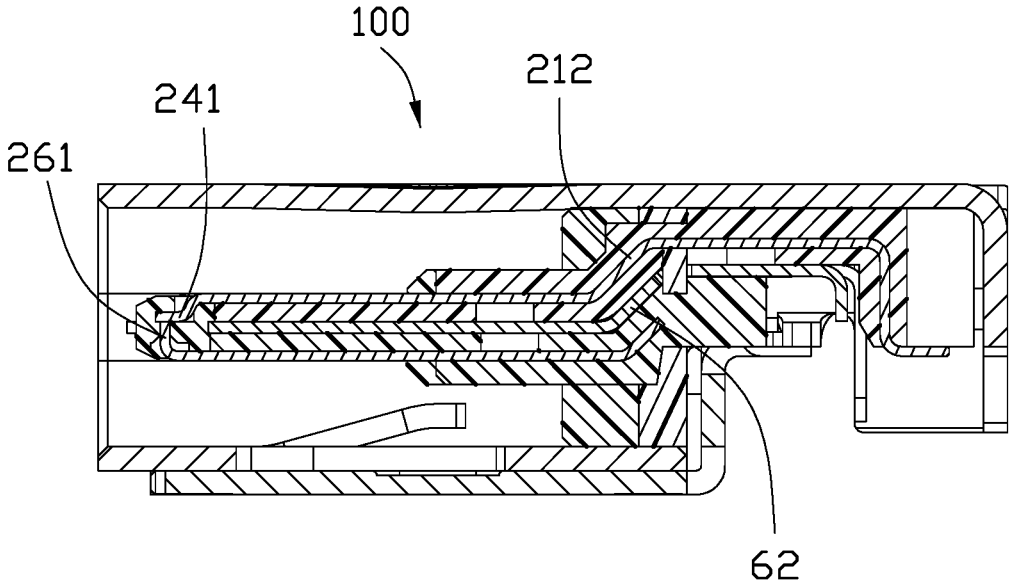
FIG. 10 is a cross-sectional view of the electrical connector along line 10-10 in FIG. 1.
Figure 11:
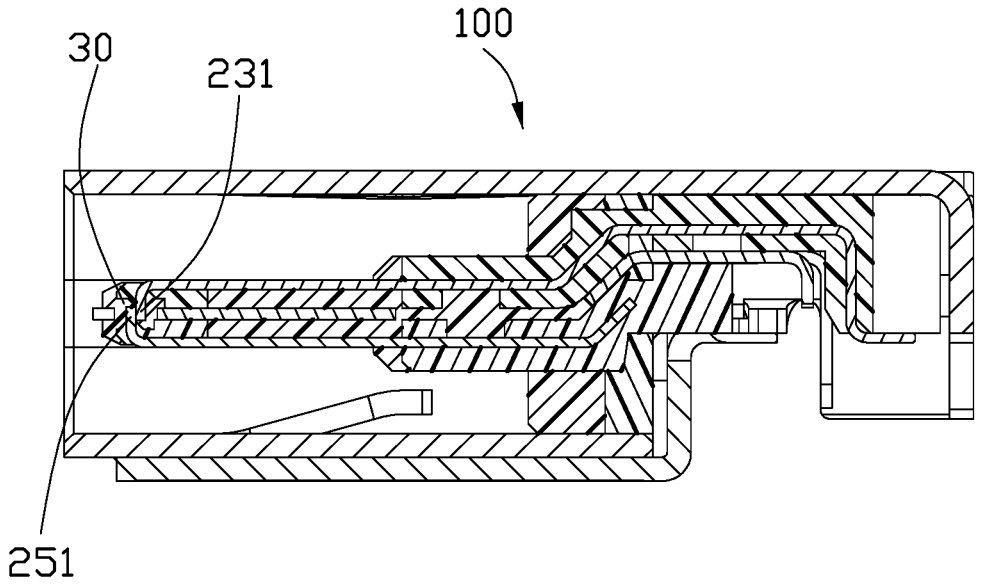
FIG. 11 is a cross-sectional view of the electrical connector along line 11-11 in FIG. 1.
Figure 12:
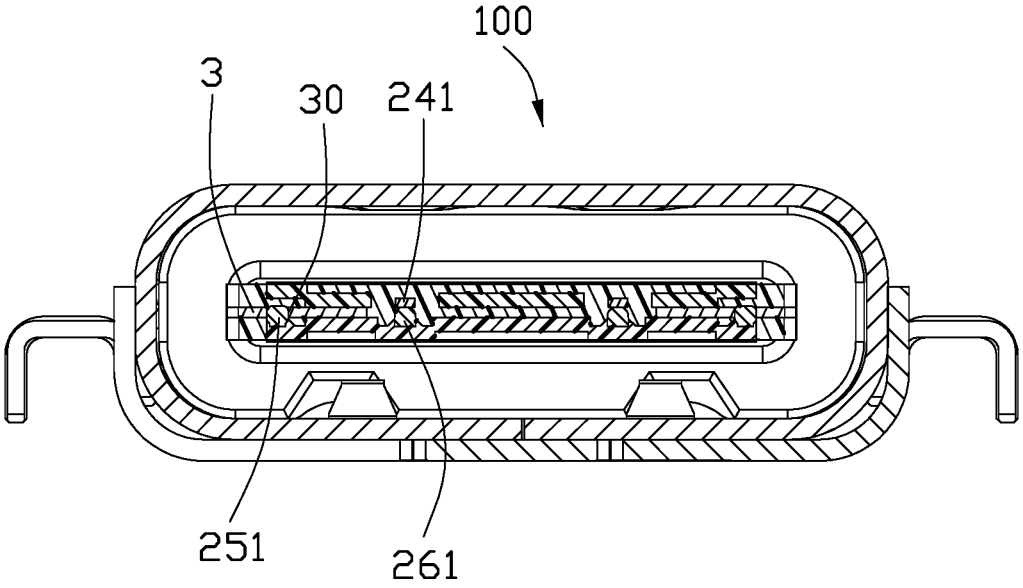
FIG. 12 is a cross-sectional view of the electrical connector along line 12-12 in FIG. 1.

Referring to FIGS. 7-12, each first grounding contact 23 of the first contacts 21 has a first end portion 231 extending downwardly and exposed from an lower surface of the second tongue portion 122. Each first power contact 24 of the first contacts 21 has a first tail/abutment portion 241 bent downwardly and extending forwardly and exposed from a front end of the second tongue portion 122. Each second grounding contact 25 of the second contacts 22 has a second end portion 251 extending upwardly, and each second power contact 26 of the second contacts 22 has a second tail/abutment portion 261 extending upwardly. The second end portion 251 and the second tail portion 261 are exposed from the upper surface of the second tongue portion 122. Referring to FIGS. 6 and 10, each first tail portion 241 is resisted against by a top end of the corresponding second tail portion 261 to form electrical parallel. Referring to FIGS. 6, 11 and 12, each first end portion 231 is resisted against by an opposite surface of the corresponding second end portion 251 to form electrical parallel. The first end portion 231 and the first tail portion 241 of the first contact 21 are lower than rest of the first contacting portion 211, and the second end portion 251 and the second tail portion 261 are higher than rest of the first contacting portion 211.

Figure 7:
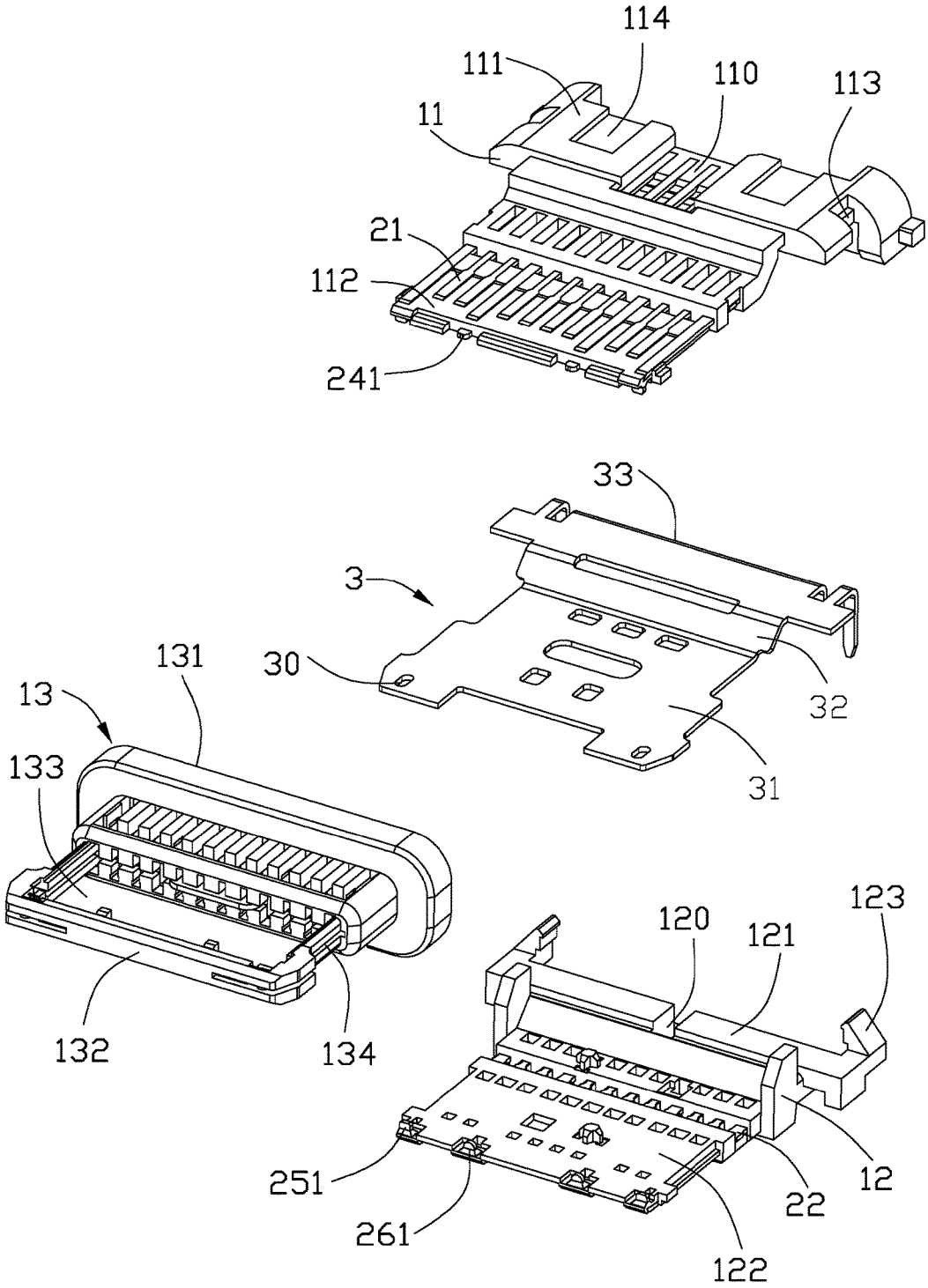
FIG. 7 is a perspective, exploded view of FIG. 5.
Figure 8:
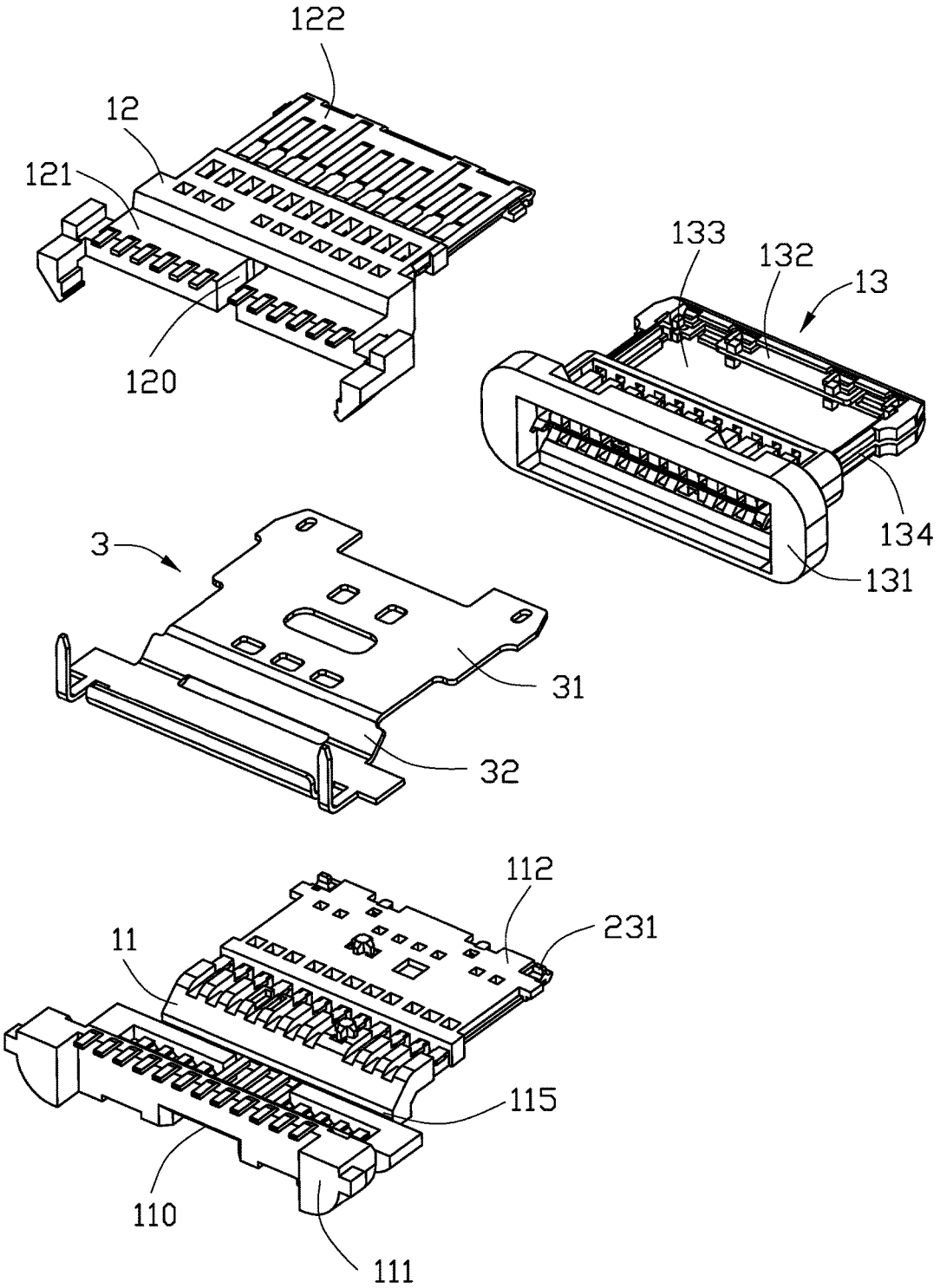
FIG. 8 is another perspective, exploded view of FIG. 7.

Referring to FIGS. 7-8, the metallic shielding plate 3, shaping like a panel, is sandwiched between the first insulative housing 11 and the second insulative housing 12. The metallic shielding plate 3 includes a supporting part 31 sandwiched between the first base portion 111 and the second base portion 121, a middle part 32 extending upwardly from a rear end of the supporting part 31, and a rear part 33 extending backwardly from a rear end of the middle part 32. The metallic shielding plate has a pair of openings 30 located at the front of the supporting part 31 to receive the first end portions 231 and the second end portions 251. Referring to FIG. 12, two sides of each opening 30 are resisted against by the corresponding second end portion 251 to enhance the contact between the first end portions 231 and the second end portions 251 to improve quality of transmitting signals and apply to high-speed signal transmitting and enhance high frequency performance.

Referring to FIGS. 1-4, the shielding shell 5 includes a top wall 51 and a bottom wall 52 located oppositely, a pair of side walls 53 connected with the top wall 51 and the bottom wall 52, and a rear wall 54 separated with the bottom wall 52. The top wall 51 has a number of projections 50 resisting the plug connector.

The metal shell 6 includes a main part 61, an afterbody 62 extending downwardly from a rear end of the main part 61, and a pair of the soldering leg 63. The afterbody 62 shields after the third base portion 131.

One feature of the invention is to have the front end portion of the grounding contact mechanically connect to a perimeter of the opening 30 of the shielding plate in an interference fit sidewardly not only resulting in the electrical connection therebetween but also enhancing the retention therebetween. On the other hand, the first end portion 231 and the second end portion 251 also abut against each other in the front-to-back direction. Also, in the instant invention the vertically extending front end portion 231, 251 does not extend in a cantilevered manner but held by a wedge like block (not labeled) of the tongue portion 112, 122 so as to assure no improper deflection yield of the front end portions of the first grounding contact and the second grounding contact when the first tongue portion 112 and the second tongue portion 122 are assembled together in the vertical direction. It is also noted that the vertical extending abutment end portion 261 of the second power contact 22 is also protected so as to abut against the horizontally extending abutment end portion 241 of the first power contact 21.

However, the disclosure is illustrative only, changes may be made in detail, especially in matter of shape, size, and arrangement of parts within the principles of the invention.

What is claimed is:

1. An electrical connector comprising:

an insulative housing;

a plurality of first contacts carried by the housing, the plurality of first contacts including a plurality of grounding contacts each having a frontal first end portion extending downwardly;

a plurality of second contacts carried by the housing, the plurality of second contacts including a plurality of grounding contacts each having a frontal second end portion extending upwardly;

a metallic shielding plate received in the housing, the metallic shielding plate respectively contacted with the first end portions and the second end portions to contact the grounding contacts of the first contacts and the grounding contacts of the second contacts, the metallic shielding plate having a plurality of openings to receive the first end portions and the second end portions, the first end portions and the second end portions respectively resisted against by inner edges of the openings in a transverse direction; and a shielding shell attached to the housing.

2. The electrical connector as claimed in claim 1, wherein each first end portion has a contacting surface in an inner surface thereof to contact with an inner surface of a corresponding second end portion.

3. The electrical connector as claimed in claim 1, wherein the plurality of first contacts include a plurality of power contacts each having a frontal first tail portion, and the plurality of second contacts include a plurality of power contacts each having a frontal second tail portion in contact with a corresponding first tail portion.

4. The electrical connector as claimed in claim 3, wherein the first tail portions of the power contacts of the first contacts are bent downwardly and extend forwardly, the second tail portions of the power contacts of the second contacts extend upwardly, and each second tail portion is contacted with a forwardly extending part of the first tail portion.

5. The electrical connector as claimed in claim 4, wherein the insulative housing has a first tongue portion and a second tongue portion located under the first tongue portion, the first end portions are exposed from a lower surface of the first tongue portion, the first tail portions are exposed from a front end of the first tongue portion, and the second end portions and the second tail portions are exposed from an upper surface of the second tongue portion.

6. The electrical connector as claimed in claim 5, wherein each first contact has a first contacting portion retained in an upper surface of the first tongue portion, each second tongue has a second contacting portion retained in a lower surface of the second tongue portion, the first end portions and the first tail portions are leveled lower than the first contacting portions, and the second end portions and the second tail portions are leveled higher than the second contacting portions.

7. The electrical connector as claimed in claim 1, wherein the shielding shell has a plurality of projections protruding inwardly for contacting with a shell of a mating connector.

8. The electrical connector as claimed in claim 1, wherein the first contacts have a plurality of first soldering portions, the second contacts have a plurality of second soldering portions, and the first soldering portions and the second soldering portions are configured in two rows in a horizontal plane and exposed from the shielding shell.

9. An electrical connector comprising:

an insulative housing forming a mating tongue with two opposite first and second surfaces thereon;

a plurality of first contacts disposed in the housing with first contacting sections exposed upon the first surface, said first contacts including signal contacts, grounding contacts and power contacts;

a plurality of second contacts disposed in the housing with second contacting sections exposed upon the second surface, said second contacts including the signal contacts, the grounding contacts and the power contacts cooperating with the signal contacts, the grounding contacts and the power contacts in a mirror image arrangement vertically; and a metallic shielding plate disposed in the housing between said opposite first and second surfaces; wherein one of the grounding contacts of the first contacts includes a vertically extending first front end portion extending through the shielding plate in a first vertical direction perpendicular to said mating tongue and mechanically and electrically connecting to said shielding plate horizontally and sidewardly;

one of the grounding contacts of the second contacts includes a vertical extending second front end portion extending through the shielding plate in a second vertical direction opposite to said first vertical direction and mechanically and electrically connecting to said shielding plate horizontally and sidewardly.

10. The electrical connector as claimed in claim 9, wherein the first front end portion and the second front end portion abut against each other in a front-to-back direction perpendicular to both said first vertical direction and said second vertical direction.

11. The electrical connector as claimed in claim 9, wherein said shielding plate defines an opening in which both said first end portion and said second end portion are received.

12. The electrical connector as claimed in claim 9, wherein a root of the first front end portion is held in a wedge like block of the mating tongue, and a root of the second front end portion is held in another wedge like block of the mating tongue.

13. The electrical connector as claimed in claim 9, wherein said mating tongue includes a first tongue portion integrally formed with the first contacts via a first insert molding process, and a second tongue portion integrally formed with the contacts via another first insert molding process, and the first tongue portion and the second tongue portion commonly sandwich the shielding plate therebetween vertically to form a final assembly via a second insert molding process so as to cover the first front end portion and the second front end portion.

14. The electrical connector comprising:

an insulative housing forming a mating tongue with two opposite first and second surfaces thereon;

a plurality of first contacts disposed in the housing with first contacting sections exposed upon the first surface, said first contacts including signal contacts, grounding contacts and power contacts;

a plurality of second contacts disposed in the housing with second contacting sections exposed upon the second surface, said second contacts including the signal contacts, the grounding contacts and the power contacts cooperating with the signal contacts, the grounding contacts and the power contacts in a mirror image arrangement vertically; and a metallic shielding plate disposed in the housing between said opposite first and second surfaces; wherein one of the power contacts of the first contacts includes a vertically extending first front abutment portion extending vertically into the shielding plate, a corresponding one of the power contacts of the second contacts includes a horizontally extending second front abutment portion mechanically connecting to said first front abutment portion for electrical connection therebetween; wherein said first front abutment portion extends vertically through the shielding plate to mechanically connect the second front abutment portion while said second front abutment portion does not extend into the shielding plate vertically.

15. The electrical connector as claimed in claim 14, wherein said first front abutment portion abuts against the second front abutment portion vertically.

16. The electrical connector as claimed in claim 14, wherein the mating tongue includes a first tongue portion integrally formed with the first contacts via a first insert-molding process, and a second tongue portion integrally formed with the second contacts via another first insert-molding process, and the first tongue portion and the second tongue portion commonly sandwich the shielding plate therebetween vertically to form a final assembly via a second insert molding process so as to cover the first front abutment portion and the second front abutment portion.

17. The electrical connector as claimed in claim 14, wherein a root of the first front abutment portion is held in a wedge like block of the mating tongue, while the second front abutment portion is not held in any wedge like block of the mating tongue.

* * * * *